US008413597B1

(12) United States Patent
Samilo

(10) Patent No.: US 8,413,597 B1
(45) Date of Patent: Apr. 9, 2013

(54) APPARATUS AND METHOD FOR A FUNNEL ASSEMBLY

(76) Inventor: John Samilo, Ringgold, GA (US)

( * ) Notice: Subject to any disclaimer, the term of this patent is extended or adjusted under 35 U.S.C. 154(b) by 156 days.

(21) Appl. No.: 13/068,347

(22) Filed: May 9, 2011

Related U.S. Application Data

(60) Provisional application No. 61/395,126, filed on May 7, 2010.

(51) Int. Cl.
*D05C 15/20* (2006.01)
*D05C 15/00* (2006.01)

(52) U.S. Cl.
USPC ..... 112/80.16

(58) Field of Classification Search ..... 112/80.05, 112/80.07, 80.08, 80.16, 80.4–80.45
See application file for complete search history.

(56) References Cited

U.S. PATENT DOCUMENTS

| | | | | |
|---|---|---|---|---|
| 4,488,498 | A * | 12/1984 | Smith | 112/80.04 |
| 5,165,352 | A * | 11/1992 | Ingram | 112/80.08 |
| 5,555,826 | A * | 9/1996 | Satterfield | 112/80.04 |
| 5,588,383 | A * | 12/1996 | Davis et al. | 112/80.16 |
| 6,293,211 | B1 * | 9/2001 | Samilo | 112/80.16 |
| 8,161,896 | B1 * | 4/2012 | Ingram et al. | 112/80.05 |

* cited by examiner

*Primary Examiner* — Ismael Izaguirre
(74) *Attorney, Agent, or Firm* — Chambliss, Bahner & Stophel, P.C.

(57) ABSTRACT

An apparatus for a funnel assembly on a tufting machine comprising an exchanger bar, one or more exchanger blocks, a funnel bar or one or more funnel blocks, one or more needle assemblies including a needle having a distal end, one or more means for conveying fluid in a direction toward the distal end of the needle and a means for moving the needle assembly in a direction substantially transverse to the backing of a tufted surface covering. The exchanger bar and the exchanger block are stationary when the needle assembly moves between a retracted position and an extended position. A method comprising providing such a funnel assembly, conveying a strand of yarn in a direction toward the distal end of the needle and moving the needle assembly and funnel bar between a retracted position and an extended position.

20 Claims, 8 Drawing Sheets

APPARATUS AND METHOD FOR A FUNNEL ASSEMBLY

CROSS-REFERENCES TO RELATED APPLICATIONS/PATENTS

This application relates back to and claims the benefit of priority from U.S. Provisional Application for Patent No. 61/395,126 entitled "Apparatus and Method for Funnel Block Assembly" and filed on May 7, 2010.

FIELD OF THE INVENTION

The present invention relates generally to a tufting machine adapted to produce tufted surface coverings and particularly to a funnel assembly on such a tufting machine.

BACKGROUND AND DESCRIPTION OF THE PRIOR ART

It is known to provide a funnel assembly on a tufting machine. Conventional funnel assemblies, however, suffer from one or more disadvantages. For example, conventional funnel assemblies include a plurality of injectors and one or more solenoid valves for each needle. As a result, conventional funnel assemblies are complex and expensive to manufacture, maintain and repair. Conventional funnel assemblies are also heavy and therefore require substantial amounts of energy to operate. In addition, conventional funnel assemblies include a manifold block (or exchanger block or bar) and a funnel block or bar that both move in a transverse direction relative to the backing of a tufted surface covering in order for the needle to penetrate the backing. This also results in the use of substantial amounts of energy during operation.

It would be desirable, therefore, if an apparatus and method for a funnel assembly could be provided that would not include a plurality of injectors and one or more solenoid valves for each needle. It would also be desirable if such apparatus and method was not complex and expensive to manufacture, maintain and repair. It would be further desirable if such apparatus and method was not heavy and did not include a manifold block (or exchanger block or bar) and a funnel block or bar that both move in a transverse direction relative to the backing of a tufted surface covering in order for the needle to penetrate the backing. It would be still further desirable if such apparatus and method would reduce the amount of energy used during operation.

ADVANTAGES OF THE PREFERRED EMBODIMENTS OF THE INVENTION

Accordingly, it is an advantage of the preferred embodiments of the invention described herein to provide an apparatus and a method for a funnel assembly that does not include a plurality of injectors or one or more solenoid valves for each needle. It is also an advantage of the preferred embodiments of the invention described herein to provide an apparatus and method for a funnel assembly that is simple and inexpensive to manufacture, maintain and repair. It is a further advantage of the preferred embodiments of the invention described herein to provide an apparatus and method for a funnel assembly that is light in weight and does not include a manifold block (or exchanger block or bar) and a funnel block or bar that both move in a transverse direction relative to the backing of a tufted surface covering in order for the needle to penetrate the backing. It a still further advantage of the preferred embodiments of the invention described herein to provide an apparatus and method for a funnel assembly that reduces the amount of energy used during operation.

Additional advantages of the preferred embodiments of the invention will become apparent from an examination of the drawings and the ensuing description.

EXPLANATION OF TECHNICAL TERMS

As used herein, the term "tufted surface covering" shall mean any type of apparatus, manufacture or composition of matter adapted to partially or entirely cover a surface such as a floor, a wall and the like. The term "tufted surface covering" includes without limitation artificial turf, synthetic grass, carpeting, rugs, wall hangings and the like.

As used herein, the term "yarn" shall mean any type of material that may be penetrated into and through the backing of a tufted surface covering. The term "yarn" includes without limitation all materials used to produce artificial turf, synthetic grass, carpeting, rugs, wall hangings and the like.

SUMMARY OF THE INVENTION

The invention comprises an apparatus for a funnel assembly on a tufting machine. The preferred funnel assembly comprises an exchanger bar, one or more exchanger blocks, a funnel bar, one or more needle assemblies, one or more means for conveying fluid in a direction toward the distal end of the one or more needle assemblies and a means for moving the needle assembly in a direction substantially transverse to the backing of a tufted surface covering. In the preferred funnel assembly, the exchanger bar and the exchanger block are stationary when the needle assembly moves between a retracted position and an extended position.

In an alternative embodiment of the apparatus for a funnel assembly on a tufting machine, the preferred assembly comprises an exchanger bar, one or more exchanger blocks, a needle bar, one or more funnel blocks, one or more needle assemblies, one or more means for conveying fluid in a direction toward the distal end of the one or more needle assemblies and a means for moving the needle assembly in a direction substantially transverse to the backing of a tufted surface covering. In the preferred funnel assembly, the exchanger bar is stationary when the needle assembly moves between a retracted position and an extended position.

The invention also comprises a method for a funnel assembly on a tufting machine. The preferred method comprises the steps of providing a funnel assembly comprising an exchanger bar, one or more exchanger blocks, a funnel bar, one or more needle assemblies, one or more means for conveying fluid in a direction toward the distal end of the one or more needle assemblies and a means for moving the needle assembly in a direction substantially transverse to the backing of a tufted surface covering. In the preferred funnel assembly, the exchanger bar and the exchanger block are stationary when the needle assembly moves between a retracted position and an extended position. The preferred method also comprises the steps of conveying a strand of yarn in a direction toward the distal end of the needle assembly and moving the needle assembly and funnel bar between a retracted position and an extended position.

In an alternative embodiment of the method for a funnel assembly on a tufting machine, the preferred method comprises the steps of providing a funnel assembly comprising an exchanger bar, one or more exchanger blocks, a needle bar, one or more funnel blocks, one or more needle assemblies, one or more means for conveying fluid in a direction toward the distal end of the one or more needle assemblies and a means for moving the needle assembly in a direction substantially transverse to the backing of a tufted surface covering. In the preferred funnel assembly, the exchanger bar and the exchanger block are stationary when the needle assembly moves between a retracted position and an extended position. The preferred method also comprises the steps of conveying a strand of yarn in a direction toward the distal end of the needle assembly and moving the needle assembly and the one or more funnel blocks between a retracted position and an extended position.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
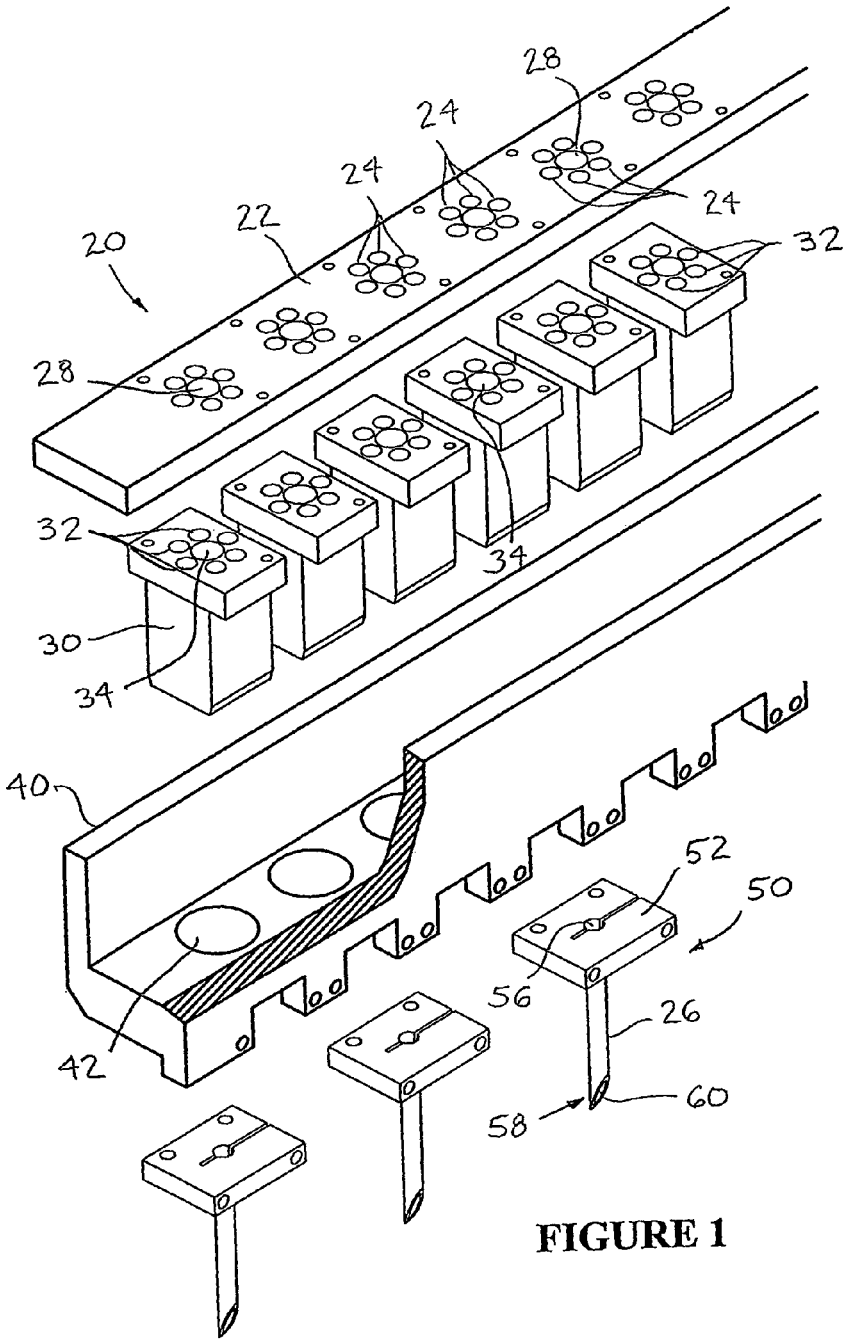
FIG. 1 is an exploded perspective view of the preferred funnel assembly in accordance with the present invention.

Referring now to the drawings, the preferred embodiments of the apparatus and method for a funnel assembly are illustrated in FIGS. 1 through 8. As shown in FIGS. 1-8, the preferred embodiments of the invention are adapted for use in connection with a tufting machine adapted to produce tufted surface coverings. Referring now to FIG. 1, an exploded perspective view of the preferred funnel assembly is illustrated. As shown in FIG. 1, the preferred funnel assembly is designated generally by reference numeral 20. The preferred funnel assembly 20 includes exchanger bar 22. The preferred exchanger bar 22 is adapted to allow one or more strands of yarn to pass through it. The preferred exchanger bar 22 includes a plurality of exchanger bar yarn holes 24, each of which is adapted to permit a strand of yarn to pass therethrough. Preferably, the number of exchanger bar yarn holes 24 corresponds to the number of strands of yarn that may be supplied to each needle 26. However, it is contemplated within the scope of the invention that the number of exchanger bar yarn holes 24 may be different from the number of strands of yarn that may be supplied to each needle 26. Further, while the preferred exchanger bar 22 illustrates six exchanger bar yarn holes 24 for each needle 26, it is contemplated within the scope of the invention that fewer or more than six exchanger bar yarn holes may be provided for each needle. It is also contemplated that the number, configuration and arrangement of the preferred exchanger bar yarn holes 24 for one needle may be different from the number, configuration and arrangement of the preferred exchanger bar yarn holes 24 for another needle. It is still further contemplated that the preferred exchanger bar 22 may be of any suitable configuration and arrangement.

Still referring to FIG. 1, the preferred exchanger bar 22 includes an exchanger bar injector hole 28. The preferred exchanger bar injector hole 28 is adapted to permit a hose, tube or other means for conveying fluid to pass through the exchanger bar. While FIG. 1 illustrates the preferred configuration and arrangement of the exchanger bar injector hole, it is contemplated within the scope of the invention that the exchanger bar injector hole may be of any suitable configuration or arrangement. It is also contemplated within the scope of the invention that more than one exchanger bar injector hole may be provided for each exchanger block 30 and/or needle 26.

Still referring to FIG. 1, the preferred funnel assembly 20 includes a plurality of exchanger blocks 30. Each preferred exchanger block 30 is adapted to allow one or more strands of yarn to pass through it. The preferred exchanger block 30 includes a plurality of exchanger block yarn holes 32, each of which is adapted to permit a strand of yarn to pass therethrough. Preferably, the number of exchanger block yarn holes 32 corresponds to the number of strands of yarn that are supplied to each needle 26 and to the number of exchanger bar yarn holes 24. However, it is contemplated within the scope of the invention that the number of exchanger block yarn holes 32 may be different from the number of strands of yarn supplied to each needle 26 and/or the number of exchanger bar yarn holes 24. Further, while each of the preferred exchanger blocks 30 illustrates six exchanger block yarn holes 32 for each needle 26, it is contemplated within the scope of the invention that fewer or more than six exchanger block yarn holes may be provided for each needle. It is also contemplated that the number and arrangement of the preferred exchanger block yarn holes 32 for one needle may be different from the number, configuration and arrangement of the preferred exchanger block yarn holes 32 for another needle. It is still further contemplated that the preferred exchanger block 30 may be of any suitable configuration and arrangement. In addition, it is contemplated within the scope of the invention that the exchanger bar and the exchanger blocks may be a single, integral component or removably or fixedly attached to each other. While FIG. 1 illustrates six exchanger blocks 30, it is contemplated within the scope of invention that more or fewer than six exchanger blocks may be provided. Preferably, exchanger bar 22 and exchanger blocks 30 are stationary during operation of a tufting machine, i.e. when the needle assembly moves between a retracted position and an extended position. It is contemplated within the scope of the invention, however, that they may be movably mounted to the tufting machine.

Referring still to FIG. 1, each of the preferred exchanger blocks 30 includes an exchanger block injector hole 34. The preferred exchanger block injector hole 34 is adapted to permit a hose, tube or other means for conveying fluid to pass through the exchanger block. While FIG. 1 illustrates the preferred configuration and arrangement of the exchanger block injector hole, it is contemplated within the scope of the invention that the exchanger block injector hole may be of any suitable configuration or arrangement. It is also contemplated within the scope of the invention that more than one exchanger block injector hole may be provided for each needle.

Still referring to FIG. 1, the preferred funnel assembly 20 also includes funnel bar 40. The preferred funnel bar 40 is adapted to allow one or more strands of yarn to pass through the funnel bar. In addition, the preferred funnel bar 40 is adapted to move relative to the preferred exchanger bar 22 and the preferred exchanger blocks 30. Preferably, funnel bar 40 is moved relative to exchanger bar 22 and exchanger blocks 30 by a power source such as an electric motor or the like. It is contemplated within the scope of the invention, however, that the funnel bar may be moved relative to the exchanger bar and the exchanger block by any suitable means, including but not limited to, hydraulic actuators, pneumatic actuators and the like.

As shown in FIG. 1, the preferred funnel bar 40 includes a plurality of funnel bar holes 42 adapted to permit one or more strands of yarn to pass through it. Preferably, the number of funnel bar holes 42 corresponds to the number of exchanger blocks 30 and to the number of needles 26. However, it is contemplated within the scope of the invention that the number of funnel bar holes 42 may be different from the number of exchanger blocks 30 and/or the number of needles 26. It is also contemplated that the number, configuration and arrangement of the preferred funnel bar holes 42 for one needle may be different from the number, configuration and arrangement of the preferred funnel bar holes for another needle. It is still further contemplated that the preferred funnel bar 40 may be of any suitable configuration and arrangement. In addition, it is contemplated within the scope of the invention that the funnel bar and the exchanger blocks or the funnel bar, the exchanger blocks and the exchanger bar may be a single, integral component or removably or fixedly attached to each other. While FIG. 1 illustrates a one-piece funnel bar 40, it is contemplated within the scope of invention that the funnel bar may comprise a plurality of funnel bar segments.

Referring still to FIG. 1, the preferred funnel assembly 20 also includes needle assembly 50. The preferred needle assembly 50 is adapted to be mounted to funnel bar 40 and allow one or more strands of yarn to pass through the needle. In addition, the preferred needle assembly 50 is adapted to be moved in a direction substantially transverse to the backing of a tufted surface covering such that when it is in an extended position it penetrates through the backing of the tufted surface covering and when it is in a retracted position it does not penetrate through the backing of the tufted surface covering. As shown in FIG. 1, the preferred needle assembly 50 includes needle holder 52 and needle 26. The preferred needle holder 52 is adapted to be mounted to funnel bar 40 and includes needle holder hole 56 which is adapted to allow one or more strands of yarn to pass through the needle holder. The preferred needle 26 is adapted to be mounted to needle holder 52 and includes distal end 58 and needle hole 60 which allows one or more strands of yarn to pass through the needle. While FIG. 1 illustrates the preferred needle assembly 50, it is contemplated within the scope of the invention that any suitable needle assembly may be provided. It is also contemplated within the scope of the invention that the needle assembly moves relative to the funnel bar.

Figure 2:
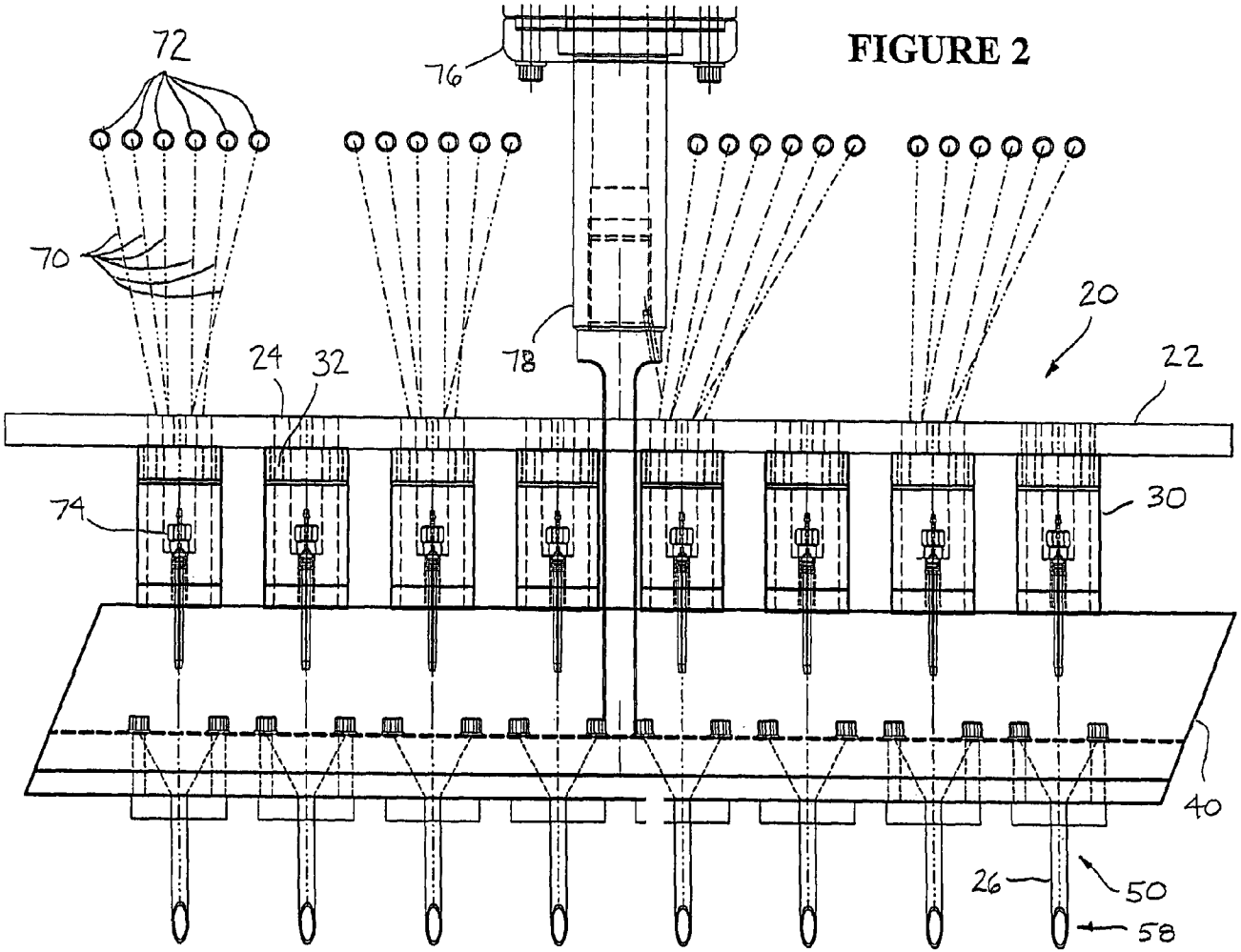
FIG. 2 is a partial section front view of the preferred funnel assembly illustrated in FIG. 1.

Referring now to FIG. 2, a partial sectional front view of the preferred funnel assembly 20 is illustrated. As shown in FIG. 2, preferred funnel assembly 20 includes exchanger bar 22, a plurality of exchanger blocks 30, funnel bar 40 and a plurality of needle assemblies 50. Also shown in FIG. 2, each one of a plurality of strands of yarn 70 preferably extends from one of a plurality of yarn sources 72 and is preferably adapted to pass through one of the exchanger bar yarn holes 24 of exchanger bar 22. In addition, each of the preferred plurality of strands of yarn 70 is adapted to pass through one of the exchanger block yarn holes 32 of exchanger block 30. Preferably, an injector 74 is mounted to each exchanger block 30. The preferred injector 74 is adapted to produce a vacuum effect in funnel bar 40 such that the one or more strands of yarn is urged in a direction toward the distal end 58 of needle 26 in needle assembly 50. More particularly, the preferred injector 74 is adapted to produce air flow in the direction away from the injector and toward the distal end 58 of needle 26. It is contemplated within the scope of the invention, however, that the preferred injector may be mounted on the exchanger bar, the funnel bar and/or the needle assembly. It is also contemplated that any suitable means for conveying a fluid in a direction toward the distal end of the needle may be provided, including but not limited to, a vacuum or suction device mounted in the funnel bar and/or the needle assembly.

Referring still to FIG. 2, the preferred funnel assembly 20 includes push rod housing 76 which contains push rod 78. The preferred push rod 78 is adapted to move funnel assembly 20 between a retracted position and an extended position. As described in more detail below and illustrated in FIGS. 4-5A, preferred funnel assembly 20 is moved between a retracted position and an extended position by an assembly comprising a main shaft having a cam that is adapted to move push rod 78 between a retracted position and an extended position.

Figure 3:
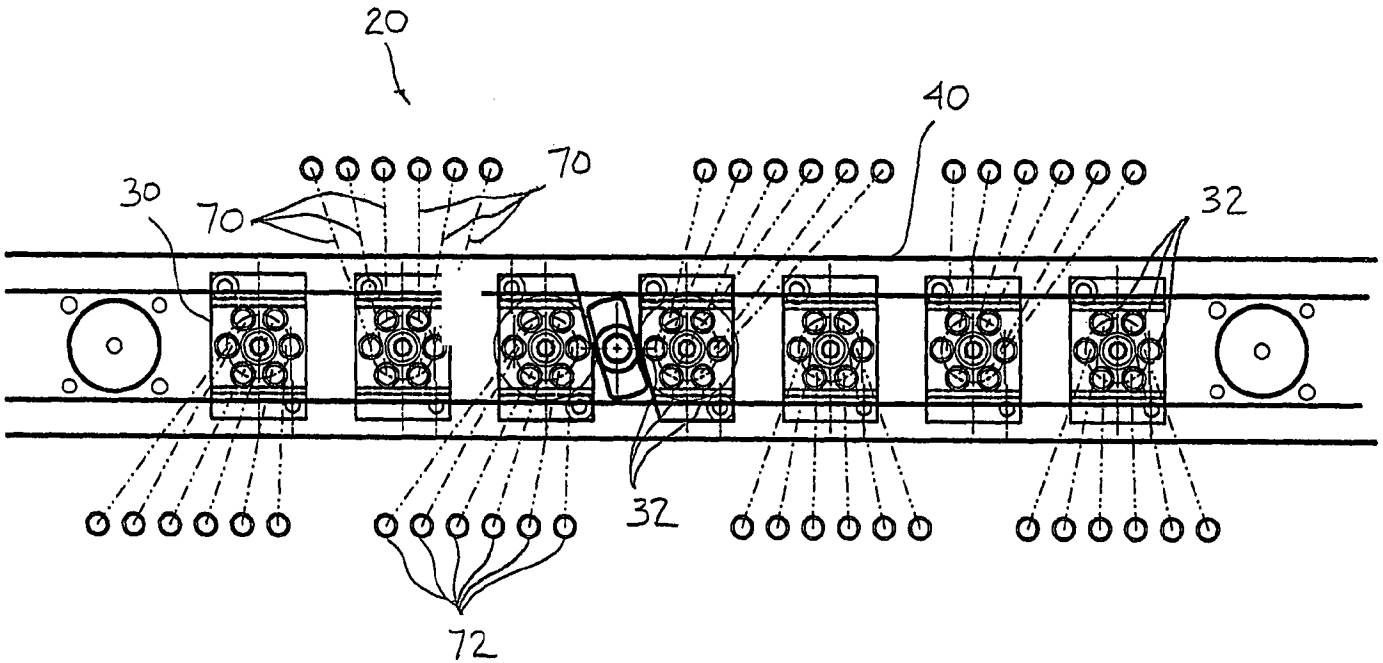
FIG. 3 is a top view of the preferred funnel assembly illustrated in FIGS. 1-2.

Referring now to FIG. 3, a top view of preferred funnel assembly 20 is illustrated. More particularly, FIG. 3 illustrates preferred funnel assembly 20 without exchanger bar 22. As shown in FIG. 3, the preferred yarn sources 72 are positioned on opposite sides of funnel assembly 20 in alternating fashion. Each of the preferred strands of yarn 70 extends from one of the yarn sources 72 to one of the exchanger block yarn holes 32. While FIG. 3 illustrates the preferred configuration and arrangement of the yarn sources, the strands of yarn and the exchanger blocks, it is contemplated within the scope of the invention that the yarn sources, the strands of yarn and the exchanger blocks may be configured and arranged in any suitable manner.

Figure 4:
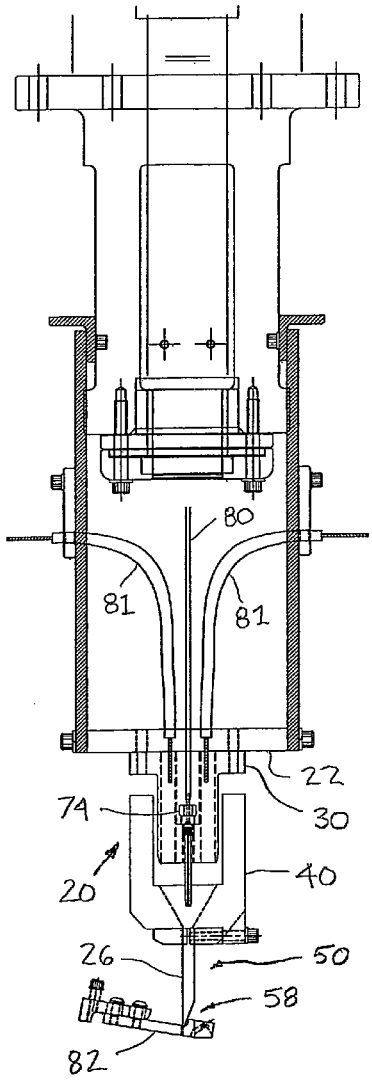
FIG. 4 is a partial sectional left side view of the preferred funnel assembly illustrated in FIGS. 1-3 showing the funnel bar assembly in a retracted position.

Referring now to FIG. 4, a partial sectional left side view of preferred funnel assembly 20 is illustrated. More particularly, FIG. 4 illustrates preferred funnel assembly 20 with funnel bar 40 and needle assembly 50 in a retracted position. As shown in FIG. 4, fluid hose 80 is adapted to pass through exchanger bar injector hole 28 of exchanger bar 22 and exchanger block injector hole 34 of exchanger block 30. The preferred fluid hose 80 is adapted to convey a fluid such as compressed air to injector 74 via an air compressor such that yarn will be urged in the direction of distal end 58 of needle 26. The preferred funnel assembly 20 also includes yarn hoses 81. The preferred yarn hoses 81 are adapted pass through exchanger bar yarn holes 24 and convey yarn to exchanger block yarn holes 32. As shown in FIG. 4, when the preferred funnel bar 40 and needle assembly 50 are in a retracted position, exchanger blocks 30 are partially disposed within the funnel bar and the distal end 58 of needle 26 does not extend beyond presser foot 82. While FIG. 4 illustrates the preferred number, configuration and arrangement of the hoses, it is contemplated within the scope of the invention that the hoses may be of any suitable number, configuration or arrangement. It is also contemplated that the hoses may be replaced by tubes, conduits, pipes or any other suitable means for conveying fluid to the injector.

Figure 5:
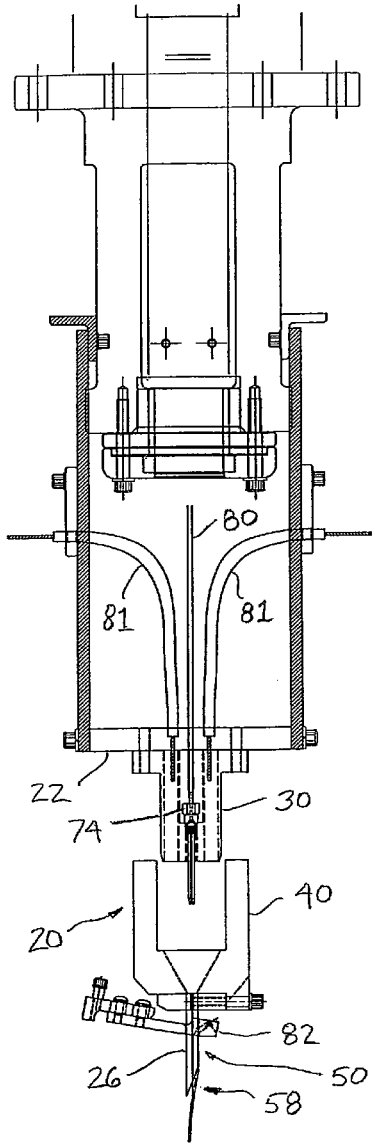
FIG. 5 is a partial sectional left side view of the preferred funnel assembly illustrated in FIGS. 1-4 showing the funnel bar assembly in an extended position.

Referring now to FIG. 5, a partial sectional left side view of the preferred funnel assembly 20 is illustrated. More particularly, FIG. 5 illustrates funnel assembly 20 with funnel bar 40 and needle assembly 50 in an extended position. As shown in FIG. 5, when the preferred funnel bar 40 and needle assembly 50 are in an extended position, exchanger block 30 is not contained within the funnel bar. In addition, when the preferred funnel bar 40 and needle assembly are in an extended position, the distal end 58 of needle 26 extends beyond presser foot 82.

Figure 5A:
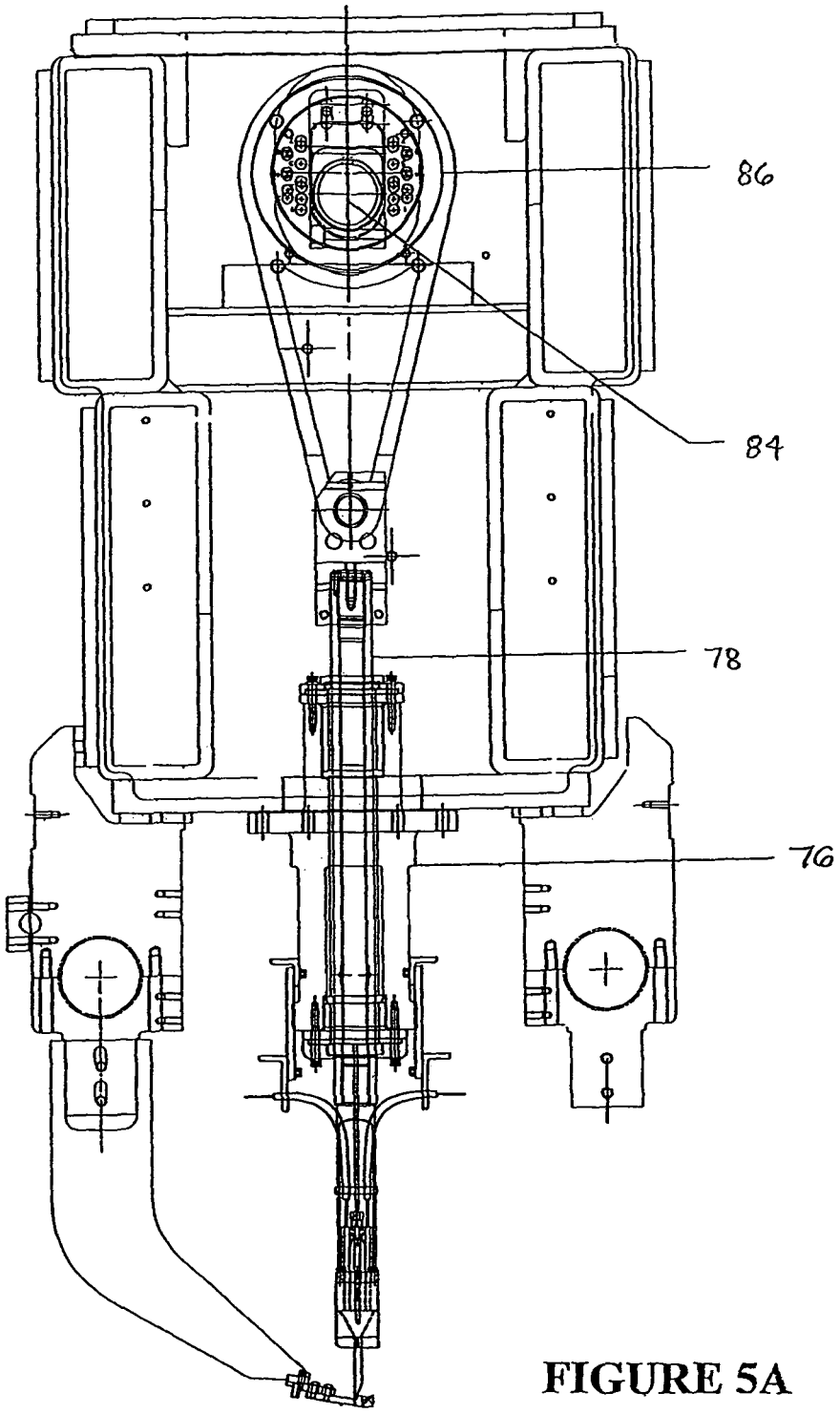
FIG. 5A is a partial sectional left side view of an exemplary assembly for moving the preferred funnel assembly illustrated in FIGS. 1-5 between a retracted position and an extended position.

Referring now to FIG. 5A, a partial sectional left side view of an exemplary assembly for moving the preferred funnel assembly 20 between a retracted position and an extended position is illustrated. As shown in FIG. 5A, the preferred funnel assembly 20 is moved between a retracted position and an extended position by an assembly comprising push rod housing 76, push rod 78, main shaft 84 and cam 86. Preferably, a power source such as a motor causes main shaft 84 to rotate. As main shaft 84 rotates, preferred cam 86 drives push rod 78 between a retracted position and an extended position. The preferred push rod 78 is operatively connected to funnel bar 40 such that as push rod 78 moves between a retracted position and an extended position, funnel bar 40 and needle assembly 50 move between a retracted position and an extended position. While FIG. 5A illustrates the preferred assembly for moving funnel assembly 20 between a retracted position and an extended position, it is contemplated within the scope of the invention that the funnel assembly may be moved between a retracted position and an extended position by any suitable means.

Figure 6:
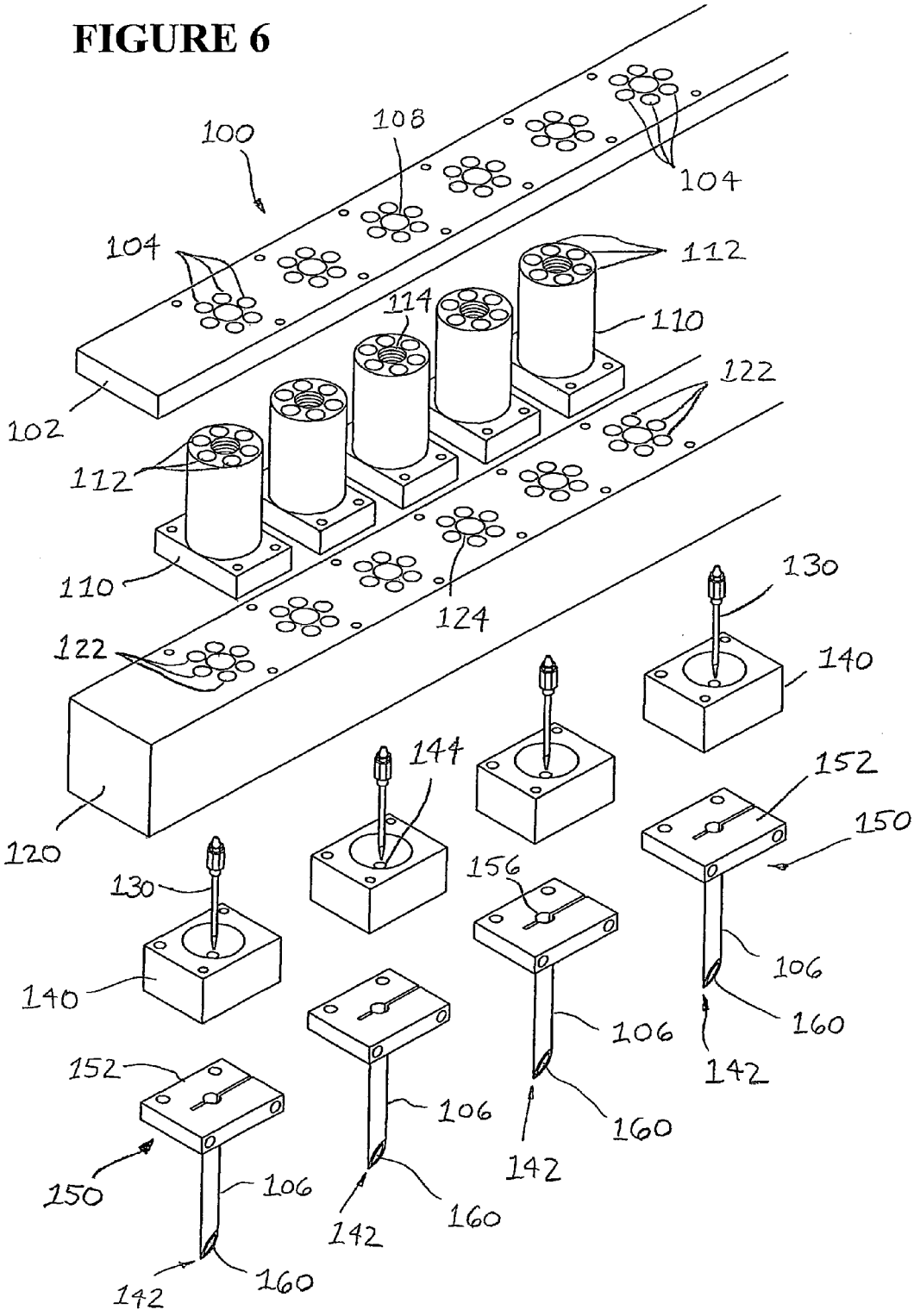
FIG. 6 is an exploded perspective view of a first alternative embodiment of the funnel assembly in accordance with the present invention.

Referring now to FIG. 6, an exploded perspective view of a first alternative embodiment of the funnel assembly in accordance with the present invention is illustrated. As shown in FIG. 6, the preferred funnel assembly is designated generally by reference numeral 100. The preferred funnel assembly 100 includes exchanger bar 102. The preferred exchanger bar 102 is adapted to allow one or more strands of yarn to pass through it. The preferred exchanger bar 102 includes a plurality of exchanger bar yarn holes 104, each of which is adapted to permit a strand of yarn to pass therethrough. Preferably, the number of exchanger bar yarn holes 104 corresponds to the number of strands of yarn that may be supplied to each needle 106. However, it is contemplated within the scope of the invention that the number of exchanger bar yarn holes 104 may be different from the number of strands of yarn that may be supplied to each needle 106. Further, while the preferred exchanger bar 102 illustrates six exchanger bar yarn holes 104 for each needle 106, it is contemplated within the scope of the invention that fewer or more than six exchanger bar yarn holes may be provided for each needle. It is also contemplated that the number, configuration and arrangement of the preferred exchanger bar yarn holes 104 for one needle may be different from the number, configuration and arrangement of the preferred exchanger bar yarn holes 104 for another needle. It is still further contemplated that the preferred exchanger bar 102 may be of any suitable configuration and arrangement. Preferably, exchanger bar 102 is stationary during operation of a tufting machine, however, it is contemplated within the scope of the invention that it may be movably mounted to the tufting machine.

Still referring to FIG. 6, the preferred exchanger bar 102 includes an exchanger bar injector hole 108. The preferred exchanger bar injector hole 114 is adapted to permit a hose, tube or other means for conveying fluid to pass through the exchanger bar. The preferred exchanger is adapted to be stationary during operation of the tufting machine, i.e. when the needle assembly moves between a retracted position and an extended position. While FIG. 6 illustrates the preferred configuration and arrangement of the exchanger bar injector hole, it is contemplated within the scope of the invention that the exchanger bar injector hole may be of any suitable configuration or arrangement. It is also contemplated within the scope of the invention that more than one exchanger bar injector hole may be provided for each exchanger block and/or needle.

Still referring to FIG. 6, the preferred funnel assembly 100 includes a plurality of exchanger blocks 110. Each preferred exchanger block 110 is adapted to allow one or more strands of yarn to pass through the exchanger block. The preferred exchanger block 110 includes a plurality of exchanger block yarn holes 112. Preferably, the number of exchanger block yarn holes 112 corresponds to the number of strands of yarn that may be supplied to each needle 106 and to the number of exchanger bar yarn holes 104. However, it is contemplated within the scope of the invention that the number of exchanger block yarn holes 112 may be different from the number of strands of yarn supplied to each needle 106 and/or the number of exchanger bar yarn holes 104. Further, while each of the preferred exchanger blocks 110 illustrates six exchanger block yarn holes 112 for each needle 106, it is contemplated within the scope of the invention that fewer or more than six exchanger block yarn holes may be provided for each needle. It is also contemplated that the number and arrangement of the preferred exchanger block yarn holes 112 for one needle may be different from the number, configuration and arrangement of the preferred exchanger block yarn holes 112 for another needle. It is still further contemplated that the preferred exchanger block 110 may be of any suitable configuration and arrangement. In addition, it is contemplated within the scope of the invention that the exchanger bar and the exchanger blocks may be a single, integral component or removably or fixedly attached to each other. While FIG. 6 illustrates six exchanger blocks 110, it is contemplated within the scope of invention that more or fewer than six exchanger blocks may be provided. In addition, the preferred exchanger blocks 110 are adapted to move relative to the preferred exchanger bar 102. It is contemplated within the scope of the invention, however, that the exchanger blocks do not move relative to the exchanger bar.

Referring still to FIG. 6, each of the preferred exchanger blocks 110 includes an exchanger block injector hole 114. The preferred exchanger block injector hole 108 is adapted to permit a hose, tube or other means for conveying fluid to pass through the exchanger block. While FIG. 6 illustrates the preferred configuration and arrangement of the exchanger block injector hole, it is contemplated within the scope of the invention that the exchanger block injector hole may be of any suitable configuration or arrangement. It is also contemplated within the scope of the invention that more than one exchanger block injector hole may be provided for each needle.

Still referring to FIG. 6, the preferred funnel assembly 100 includes needle bar 120. The preferred needle bar 120 is adapted to allow one or more strands of yarn to pass through it. In addition, the preferred needle bar 120 is adapted to move relative to the preferred exchanger bar 102 and to move with the preferred exchanger blocks 110. As shown in FIG. 6, the preferred needle bar 120 includes a plurality of needle bar yarn holes 122, each of which is adapted to permit one or more strands of yarn to pass therethrough. Preferably, the number of needle bar yarn holes 122 corresponds to the number of strands of yarn that may be supplied to each needle 106 and to the number of exchanger bar yarn holes 104 and/or the number of exchanger bar yarn holes 104. However, it is contemplated within the scope of the invention that the number of needle bar yarn holes 122 may be different from the number of strands of yarn supplied to each needle 106 and/or the number of exchanger bar yarn holes 104 and/or the number of exchanger block yarn holes 112. It is also contemplated that the number, configuration and arrangement of the preferred needle bar yarn holes 122 for one needle may be different from the number and arrangement of the preferred needle bar yarn holes 112 for another needle. It is still further contemplated that the preferred needle bar 120 may be of any suitable configuration and arrangement. In addition, it is contemplated within the scope of the invention that the needle bar and the exchanger blocks may be a single, integral component or removably or fixedly attached to each other. While FIG. 6 illustrates a one-piece needle bar 120, it is contemplated within the scope of invention that the needle bar may comprise a plurality of needle bar segments. In addition, the preferred needle bar 120 is adapted to move relative to the preferred exchanger bar 102. It is contemplated within the scope of the invention, however, that the needle bar does not move relative to the exchanger bar.

Referring still to FIG. 6, the preferred needle bar 120 includes a needle bar injector hole 124. The preferred needle bar injector hole 124 is adapted to permit an injector, hose, tube or other means for conveying fluid to pass through the needle bar. Preferably, the number of needle bar injector holes 122 corresponds to the number of exchanger blocks 110 and to the number of needles 106. However, it is contemplated within the scope of the invention that the number of needle bar injector holes 122 may be different from the number of exchanger blocks 110 and/or from the number of needles 106. While FIG. 6 illustrates the preferred configuration and arrangement of the needle bar injector hole, it is contemplated within the scope of the invention that the needle bar injector hole may be of any suitable configuration or arrangement.

Still referring to FIG. 6, the preferred funnel assembly 100 includes injectors 130. Each of the preferred injectors 130 is mounted to an exchanger block 110. Each of the preferred injectors 130 is adapted to produce a vacuum effect in one of the funnel blocks 140 such that the one or more strands of yarn is urged in a direction toward the distal end 142 of needle 106. More particularly, the preferred injector 130 is adapted to produce air flow in the direction away from the injector and toward the distal end 142 of needle 106. It is contemplated within the scope of the invention, however, that the preferred injector may be mounted on the needle bar, the funnel block and/or the needle assembly. It is also contemplated that any suitable means for conveying a fluid in a direction toward the distal end of the needle may be provided, including but not limited to, a vacuum or suction device mounted in the funnel bar and/or the needle assembly.

Still referring to FIG. 6, the preferred funnel assembly 100 includes funnel blocks 140. Each of the preferred funnel blocks 140 is adapted to allow one or more strands of yarn to pass through it. In addition, the preferred funnel blocks 140 are adapted to move relative to the preferred exchanger bar 102. Each of the preferred funnel blocks 140 includes a funnel block hole 144 adapted to permit one or more strands of yarn to pass through the funnel block. Preferably, the number of funnel block holes 144 corresponds to the number of exchanger blocks 110 and to the number of needles 106. However, it is contemplated within the scope of the invention that the number of funnel block holes 144 may be different from the number of exchanger blocks 110 and/or from the number of needles 106. It is also contemplated that the number, configuration and arrangement of the preferred funnel block holes 144 for one needle may be different from the number and arrangement of the preferred funnel block holes 144 for another needle. It is still further contemplated that the preferred funnel block 140 may be of any suitable configuration and arrangement. In addition, it is contemplated within the scope of the invention that the funnel blocks and the needle bar or the funnel blocks, the needle bar and the exchanger blocks may be a single, integral component or removably or fixedly attached to each other. While FIG. 6 illustrates a plurality of separate funnel blocks, it is contemplated with in the scope of the invention that a one-piece funnel bar may be used. It is also contemplated within the scope of the invention that the funnel blocks do not move relative to the exchanger bar.

Referring still to FIG. 6, the preferred funnel assembly 100 also includes needle assemblies 150. Each of the preferred needle assemblies 150 is adapted to be mounted to a funnel block 140 and allow one or more strands of yarn to pass through the needle. In addition, each of the preferred needle assemblies 150 is adapted to be moved in a direction substantially transverse to the backing of a tufted surface covering such that when it is in an extended position it penetrates through the backing of the tufted surface covering and when it is in a retracted position it does not penetrate through the backing of the tufted surface covering. As shown in FIG. 6, the preferred needle assembly 150 includes needle holder 152 and needle 106. The preferred needle holder 152 is adapted to be mounted to funnel block 140 and includes needle holder hole 156 which is adapted to allow one or more strands of yarn to pass through the needle holder. The preferred needle 106 is adapted to be mounted to needle holder 152 and includes distal end 142 and needle hole 160 which allows one or more strands of yarn to pass through the needle. While FIG. 6 illustrates the preferred needle assembly 150, it is contemplated within the scope of the invention that any suitable needle assembly may be provided.

Referring still to FIG. 6, preferably exchanger blocks 110, needle bar 120, injector 130, funnel blocks 140 and needle assemblies 150 are moved relative to exchanger bar 102 by a power source such as an electric motor or the like. It is contemplated within the scope of the invention, however, that the exchanger blocks 110, needle bar 120, injector 130, funnel blocks 140 and needle assemblies 150 may be moved relative to the exchanger bar by any suitable means, including but not limited to, hydraulic actuators, pneumatic actuators and the like.

Figure 7:
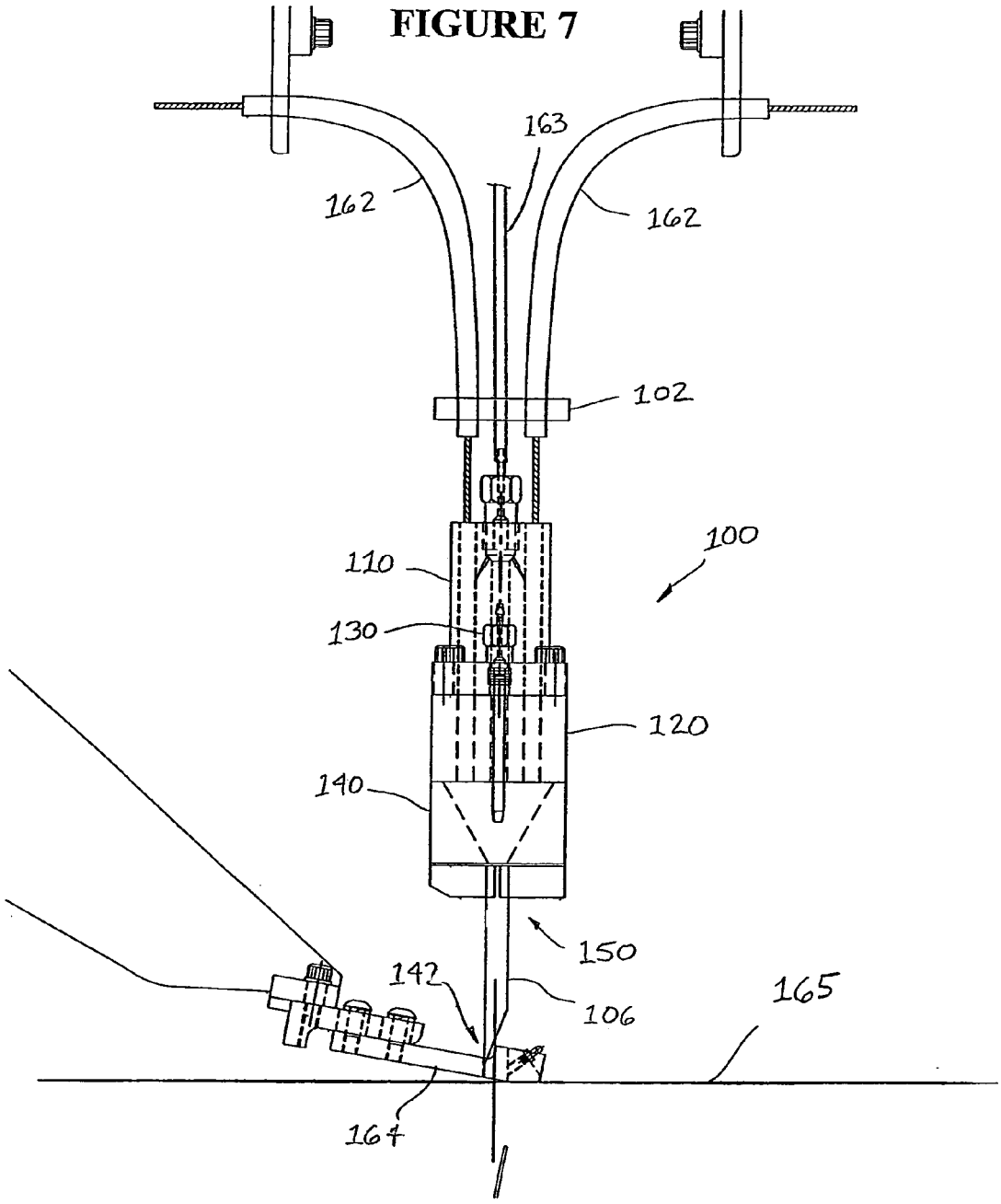
FIG. 7 is a partial sectional left side view of the first alternative embodiment of the funnel assembly illustrated in FIG. 6 showing the funnel assembly in a retracted position.

Referring now to FIG. 7, a partial sectional left side view of preferred funnel assembly 100 is illustrated. More particularly, FIG. 7 illustrates preferred funnel assembly 100 with exchanger block 110, needle bar 120, injector 130, funnel block 140 and needle assembly 150 in a retracted position. As shown in FIG. 7, each yarn hose 162 is adapted to pass through an exchanger bar yarn hole of exchanger bar 102 and an exchanger block yarn hole of exchanger block 110. The preferred yarn hoses 162 are adapted to convey yarn to exchanger block 110. The preferred funnel assembly 100 also includes fluid hose 163. The preferred fluid hose 163 is adapted to pass through exchanger bar injector hole 108 and convey a fluid such as compressed air to injector 130 such that yarn strands will be urged in the direction of distal end 142 of needle 106. As shown in FIG. 7, when the preferred exchanger block 110, needle bar 120, injector 130, funnel block 140 and needle assembly 150 are in a retracted position, the distal end 142 of needle 106 does not extend beyond presser foot 164 and would not penetrate through the backing of a tufted surface covering. While FIG. 7 illustrates the preferred configuration and arrangement of the hoses, it is contemplated within the scope of the invention that the hoses may be of any suitable configuration or arrangement. It is also contemplated that the hoses may be replaced by tubes, conduits, pipes or any other suitable means for conveying yarn to the needle or fluid to the injector.

Figure 8:
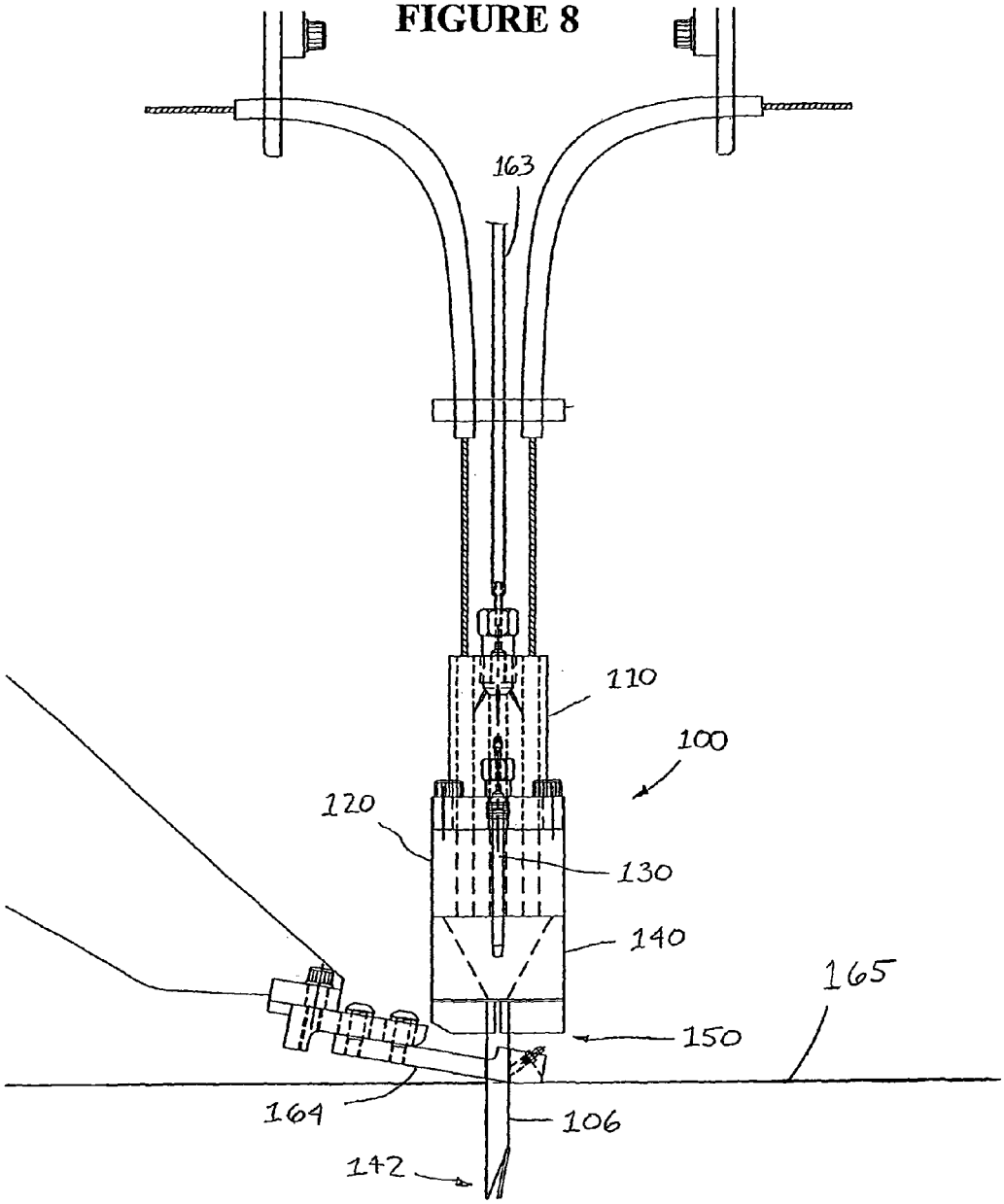
FIG. 8 is a partial sectional left side view of the first alternative embodiment of the funnel assembly illustrated in FIGS. 6 and 7 showing the funnel assembly in an extended position.

Referring now to FIG. 8, a partial sectional left side view of the preferred funnel assembly 100 is illustrated. More particularly, FIG. 8 illustrates funnel assembly 100 with the preferred exchanger block 110, needle bar 120, injector 130, funnel block 140 and needle assembly 150 in an extended position. As shown in FIG. 8, when the preferred exchanger block 110, needle bar 120, injector 130, funnel block 140 and needle assembly 150 are in an extended position, the distal end 142 of needle 106 extends beyond presser foot 164 and penetrate through the backing 165 of a tufted surface covering. It is contemplated within the scope of the invention that the preferred funnel assembly 100 may be moved between a retracted position and an extended position by any suitable means such as the assembly illustrated in FIG. 5A.

The invention also comprises a method for producing a tufted surface covering. According to the preferred embodiments of the method for producing a tufted surface covering, a tufting machine having a funnel assembly as described herein is provided. The preferred embodiments of the method for producing a tufted surface covering include moving the funnel bar and the needle assembly in a direction substantially transverse to the backing of a tufted surface covering between a retracted position and an extended position in order to penetrate the backing of the tufted surface covering with the distal end of the needle. In an alternative embodiment of the method for producing a tufted surface covering, the method includes moving the exchanger block, the needle bar, the injector, the funnel block and the needle assembly in a direction substantially transverse to the backing of a tufted surface covering between a retracted position and an extended position in order to penetrate the backing of the tufted surface covering with the distal end of the needle. The preferred embodiments of the method for producing a tufted surface covering also include conveying a fluid in a direction toward the distal end of the needle. The preferred embodiments of the method of the invention also comprise the step of conveying one or more strands of yarn in a direction toward the distal end of the needle assembly by means of a gear or any other suitable device, mechanism, assembly or combination thereof.

In operation, several advantages of the preferred embodiments of the invention are achieved. For example, in the preferred embodiments of the invention, the funnel assembly does not include any solenoid valves and requires only one injector for each needle. As a result, the preferred embodiments of the funnel assembly are simple and inexpensive to manufacture, maintain and repair. The preferred embodiments of the funnel assembly are light and do not include a manifold block (or exchanger block or bar) and a funnel block or bar that both move in a substantially transverse direction relative to the backing of a tufted surface covering in order for the needle to penetrate the backing. Consequently, the preferred embodiments of the funnel assembly reduce the amount of energy used during operation.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A funnel assembly on a tufting machine adapted to produce a tufted surface covering having a backing, said funnel assembly comprising:

(a) an exchanger bar;

(b) an exchanger block;

(c) a funnel bar;

(d) a needle assembly, said needle assembly including a needle having a distal end;

(e) a means for conveying fluid in a direction toward the distal end of the needle;

(f) a means for moving the needle assembly in a direction substantially transverse to the backing of the tufted surface covering;

wherein the exchanger bar and the exchanger block are stationary when the needle assembly moves between a retracted position and an extended position.

2. The funnel assembly of claim 1 wherein the exchanger bar includes a plurality of exchanger bar yarn holes and an exchanger bar injector hole.

3. The funnel assembly of claim 1 wherein the exchanger block includes a plurality of exchanger block yarn holes and an exchanger block injector hole.

4. The funnel assembly of claim 1 wherein the funnel bar includes a funnel bar hole.

5. The funnel assembly of claim 1 wherein the needle assembly includes a needle hole.

6. The funnel assembly of claim 1 wherein the means for conveying fluid in a direction toward the distal end of the needle assembly comprises an air compressor.

7. The funnel assembly of claim 1 wherein the means for moving the needle assembly in a direction substantially transverse to the backing of the tufted surface covering comprises a motor.

8. The funnel assembly of claim 1 wherein the funnel assembly receives a plurality of strands of yarn from a plurality of yarn sources.

9. The funnel assembly of claim 1 further comprising an injector mounted in the exchanger block.

10. The funnel assembly of claim 1 further comprising a push rod adapted to move the funnel assembly between a retracted position and an extended position.

11. A funnel assembly on a tufting machine adapted to produce a tufted surface covering having a backing, said funnel assembly comprising:

(a) an exchanger bar;

(b) an exchanger block;

(c) a funnel block;

(d) a needle assembly, said needle assembly including a needle having a distal end;

(e) a means for conveying fluid in a direction toward the distal end of the needle;

(f) a means for moving the needle assembly in a direction substantially transverse to the backing of the tufted surface covering;

wherein the exchanger bar is stationary when the needle assembly moves between a retracted position and an extended position.

12. The funnel assembly of claim 11 wherein the needle assembly includes a needle bar.

13. A method for a funnel assembly on a tufting machine, said method comprising:

(a) providing a funnel assembly on a tufting machine adapted to produce a tufted surface covering having a backing, said funnel assembly comprising:

(1) an exchanger bar;

(2) an exchanger block;

(3) a funnel bar;

(4) a needle assembly, said needle assembly including a needle having a distal end;

(5) a means for conveying fluid in a direction toward the distal end of the needle;

(6) a means for moving the needle assembly in a direction substantially transverse to the backing of the tufted surface covering;

wherein the exchanger bar and the exchanger block are stationary when the needle assembly moves between a retracted position and an extended position;

(b) conveying a strand of yarn in a direction toward the distal end of the needle;

(c) moving the needle assembly and funnel bar between a retracted position and an extended position.

14. The method of claim 13 further comprising a gear adapted to convey the strand of yarn in a direction toward the distal end of the needle assembly.

15. The method of claim 13 further comprising conveying a fluid to the needle assembly.

16. The method of claim 13 further comprising penetrating the backing of the tufted surface covering with the needle assembly.

17. A method for a funnel assembly on a tufting machine, said method comprising:

(a) providing a funnel assembly on a tufting machine adapted to produce a tufted surface covering having a backing, said funnel assembly comprising:

(1) an exchanger bar;

(2) an exchanger block;

(3) a funnel block;

(4) a needle assembly, said needle assembly including a needle having a distal end;

(5) a means for conveying fluid in a direction toward the distal end of the needle;

(6) a means for moving the needle assembly in a direction substantially transverse to the backing of the tufted surface covering;

wherein the exchanger bar is stationary when the needle assembly moves between a retracted position and an extended position;

(b) moving the needle assembly, funnel bar and exchanger block between a retracted position and an extended position;

(c) conveying a strand of yarn in a direction toward the distal end of the needle.

18. The method of claim 17 wherein the funnel assembly further comprises a needle assembly including a needle bar.

19. The method of claim 18 wherein the needle bar is moved between a retracted position and an extended position.

20. The method of claim 17 further comprising penetrating the backing of the tufted surface covering with the needle assembly.

* * * * *